US005118173A

United States Patent [19]

Proctor et al.

[11] Patent Number: 5,118,173

[45] Date of Patent: Jun. 2, 1992

[54] LAUNDRY HAMPER ASSEMBLY FOR THE SEGREGATED COLLECTION AND STORAGE OF SOILED LAUNDRY

[76] Inventors: Deborah Proctor, 1435 NW. 191st St., Fla. 33169; Jacqueline Erving, 19371 NE. 1st Ave., Miami, Fla. 33179

[21] Appl. No.: 648,859

[22] Filed: Jan. 31, 1991

[51] Int. Cl.[5] ..... A47B 81/00

[52] U.S. Cl. ..... 312/213; 312/229; 220/409; 220/410

[58] Field of Search ..... 312/213, 229, 250, 228; 220/23.86, 409, 410, 909; D32/37

[56] References Cited

U.S. PATENT DOCUMENTS

| | | | |
|---|---|---|---|
| D. 142,649 | 10/1945 | Kohen | D32/37 |
| 1,650,824 | 11/1927 | Eagles | 220/909 X |
| 2,520,064 | 8/1950 | Rones | 312/229 X |
| 2,625,973 | 1/1953 | Weldon et al. | 312/213 X |
| 2,736,454 | 2/1956 | McConnell | 220/909 X |
| 3,164,428 | 1/1965 | Kesh | 312/213 |
| 4,585,283 | 4/1986 | Redmon et al. | 312/250 |
| 4,801,034 | 1/1989 | Sandomeno | 220/23.83 |
| 4,878,592 | 11/1989 | Lee | 220/909 X |

*Primary Examiner*—Kenneth J. Dorner
*Assistant Examiner*—Brian K. Green
*Attorney, Agent, or Firm*—Malloy, Downey & Malloy

[57] ABSTRACT

A laundry hamper assembly including a housing structured to support several laundry baskets and a soaking tub for the collection and segregated storage of soiled laundry therein prior to washing. The laundry baskets and at least one soaking tub are each similarly configured, being adapted for receipt through and support within openings on a top of the housing. A drip compartment having a water tight construction and drain valve is disposed within the housing having hooks on an inner wall, wherein wet laundry can be hung and allowed to drip dry. A clothes pin tray formed in the top of the housing allows for the storage of clothes pin therein, and a covering lid hingedly attached to the housing is movable between an open and closed position so as to effectively cover the top of the housing.

7 Claims, 3 Drawing Sheets

LAUNDRY HAMPER ASSEMBLY FOR THE SEGREGATED COLLECTION AND STORAGE OF SOILED LAUNDRY

BACKGROUND OF THE INVENTION

1. Field of the Invention

The present invention relates generally to laundry hampers, and more particularly relates to laundry hampers adapted for the collection and segregated storage of soiled laundry prior to washing.

2. Description of the Related Art

Laundry hampers are generally known in the art, being intended for the convenient collection and storage of soiled laundry to be washed in the future. Ordinarily, the laundry hampers in the related art are of a box-like configuration and comprise a single storage compartment wherein soiled laundry of all types is stored until it is time for the laundry to be washed. Usually, the laundry being collected within the hamper consists of virtually every type of clothing worn by all of the members in the household during the ordinary course of their daily lives. Included in the collected laundry, there may be white fabrics such as socks and undergarments as well as colors, delicate fabrics, soiled athletic wear and substantially wet articles such as towels and swimsuits. When it is desired to wash the collected laundry, it is then necessary to remove the collected laundry from the hamper and segregate it into various fabric types,for separate washing in accordance with the normal washing procedures for that particular fabric type.

While laundry hampers in the related art have been found to be suitable for their intended purpose, there are numerous problems associated with most hampers presently being used. Of significance is the problem associated with collecting clothing of different fabric types in one compartment making it later necessary to segregate the soiled laundry upon removing it from the hamper. Often, the collected soiled laundry remains in the hamper for several days during which time wet articles generate a musty, stale odor. Also, soiled athletic wear, towels and washcloths are often saturated with moisture and perspiration which begins to emit a foul odor that is absorbed into the other laundry contained within the same compartment. Because there is no provision for ventilation in most hampers, the entire load of collected laundry begins to take on a rather unpleasant odor which is generally offensive to the person who takes on the unpleasant task of segregating the laundry prior to washing.

SUMMARY OF THE INVENTION

Accordingly, it is a principal object of the present invention to provide a laundry hamper assembly adapted for the collection and segregated storage of soiled laundry therein prior to washing.

It is a further object to provide a laundry hamper assembly adapted for the separate collection and storage of wet laundry.

It is yet a further object of the present invention to provide a laundry hamper assembly having ventilation means therein to provide for the ventilation of air throughout the hamper and laundry contained therein.

It is still a further object of the present invention to provide a laundry hamper assembly having means therein for soaking heavily soiled laundry prior to normal washing.

It is another object of the present invention to provide a laundry hamper assembly having a plurality of removable baskets adapted for the collection of soiled laundry therein, wherein each of the removable baskets can be individually removed from the assembly for washing of the laundry collected therein as desired.

It is a further object of the present invention to provide a laundry hamper assembly wherein a plurality of removable baskets enable the segregated collection of soiled laundry, including colors, whites and garments to be dry cleaned, and further wherein the baskets can be removed if it is desired to use on large collection bin within the hamper.

Generally, there is provided a laundry hamper assembly including a support housing having a top portion thereon. The top portion includes openings formed therethrough in direct communication with an interior chamber of the housing wherein a plurality of laundry baskets are adapted to be inserted through each of the openings extending down into the interior chamber and being supported about a flanged upper edge structured for engagement with an upper surface of the top portion. A drip compartment is located towards the rear of the housing and includes a water tight surrounding wall structure adapted to collect water dripping from wet laundry hung on a plurality of hooks affixed to an inner wall near the top portion of the housing. A valve fitting is located near the bottom of the drip compartment, wherein the collected water can be drained therefrom as necessary. Extending along the back of the top portion, there is a clothes pin tray having a semi-cylindrical dish-like configuration adapted for the placement of clothes pins therein. A plurality of ventilation grills are positioned about the outer walls of the housing being adapted to permit air flow into the interior chamber for ventilation of the soiled laundry stored within the baskets. A covering lid is hingedly attached along a top rear edge of the housing being positionable between an open, accessible position and a closed, covering position so as to effectively cover the top portion and prevent excessive emission of odors from the soiled laundry stored in the basket.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
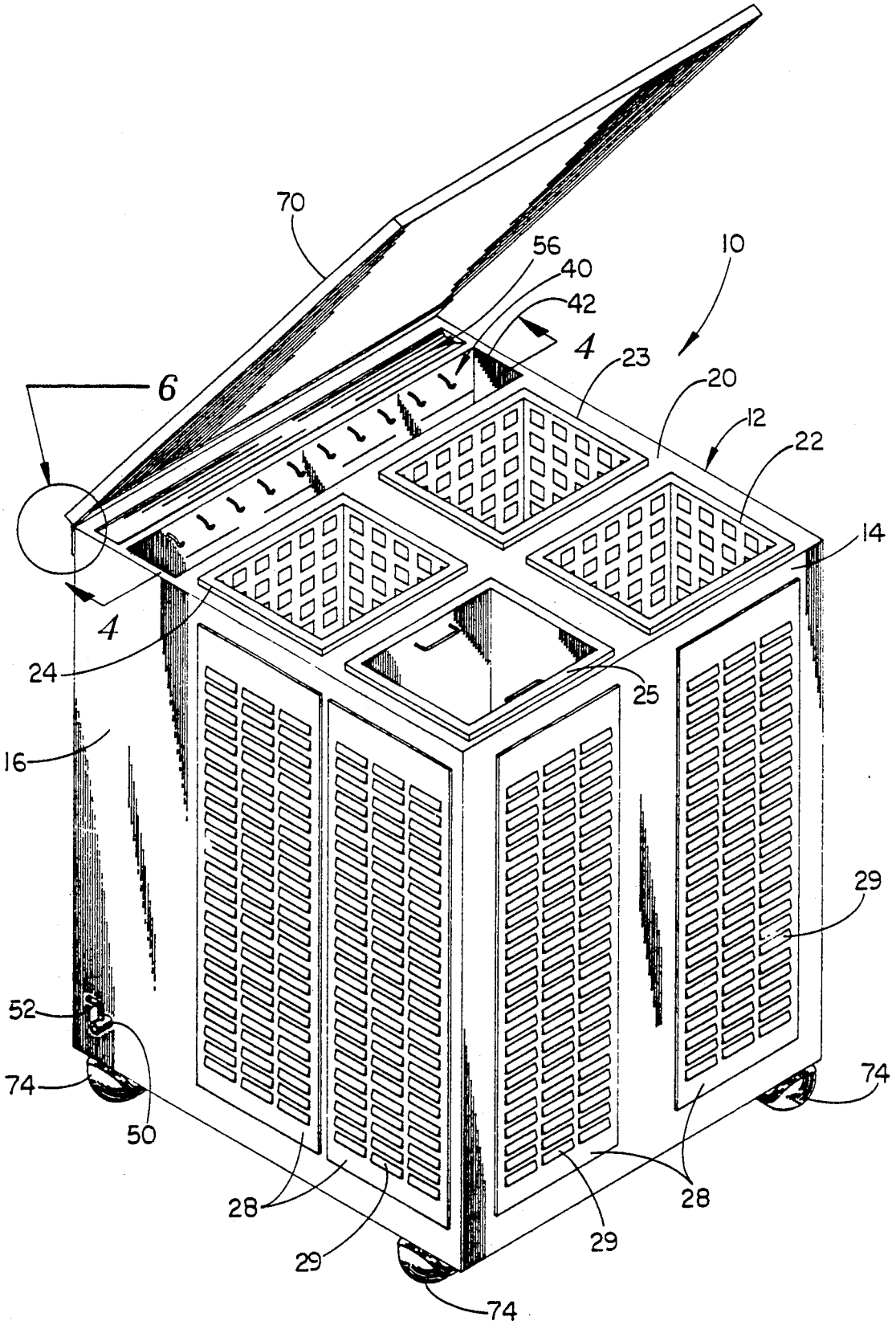
FIG. 1 is a perspective view of the laundry hamper assembly of the present invention.
Figure 4:
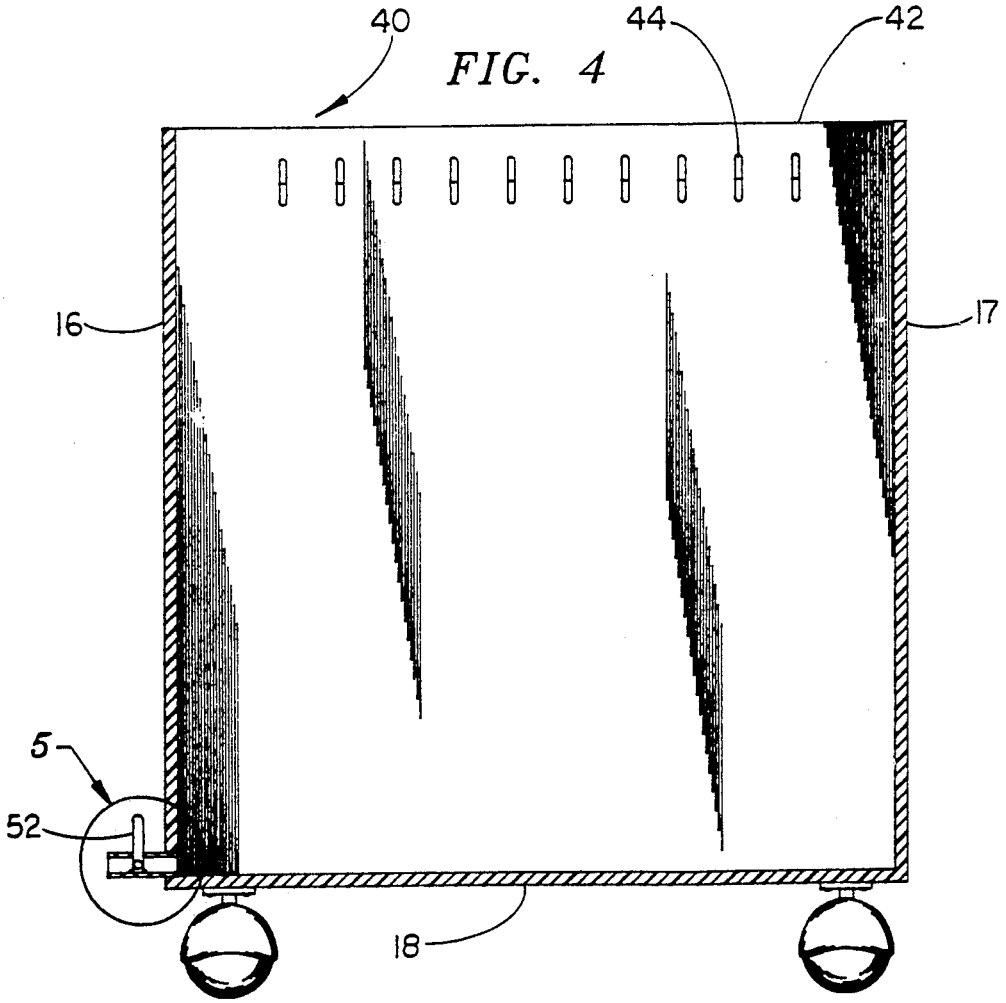
FIG. 4 is a partial sectional view taken along line 4—4 of FIG. 1.
Figure 5:
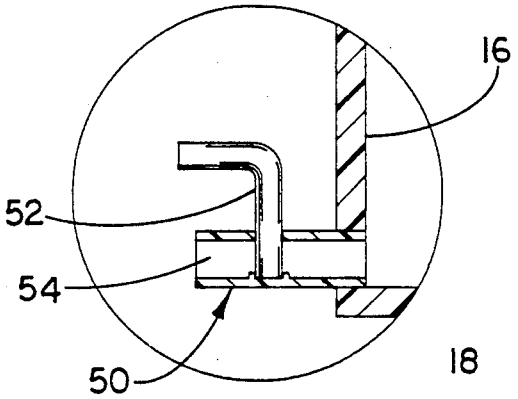
FIG. 5 is an isolated view in partial cross-section taken from the circle labeled FIG. 5 in FIG. 4 illustrating a valve fitting of the present invention.
Figure 6:
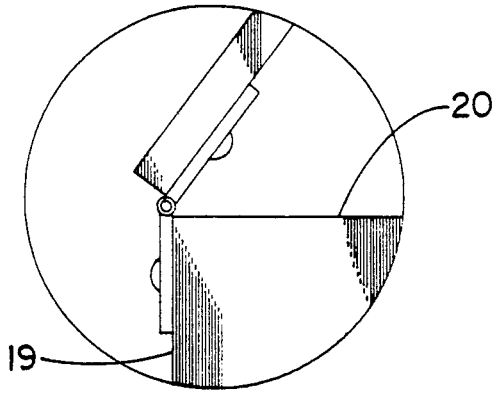
FIG. 6 is an isolated view taken from the circle labeled FIG. 6 in FIG. 1 illustrating the hinged attachment of a covering lid to the housing structure of the present invention.

With reference to FIG. 1, the present invention is directed to a laundry hamper assembly generally indicated as 10 for the collection and segregated storage of soiled laundry therein prior to washing. The laundry hamper assembly 10 includes a support housing 12 having a front wall 14, two opposite side walls 16 and 17, a bottom floor 18 (as best seen in FIG. 4), and a rear wall (not shown in the drawings). The structural housing 12 further includes a top portion 20 structured and configured for receipt of a plurality of baskets 22, 23, 24 and 25 therethrough so as to be supported in a substantially vertical orientation extending downwardly within an interior chamber of the housing 12.

Attached to at least the front wall 14 and side walls 16 and 17, there are a plurality of ventilation grills 28 having an array of air receptacles 29 formed therein, structured to permit the passage of air therethrough for ventilation of the interior chamber and accordingly, laundry stored within the baskets 22, 23 and 24.

Figure 2:
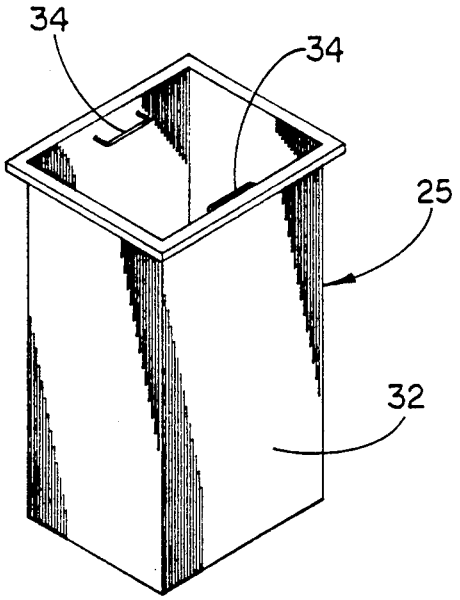
FIG. 2 is a perspective view of a soaking tub of the present invention.
Figure 3:
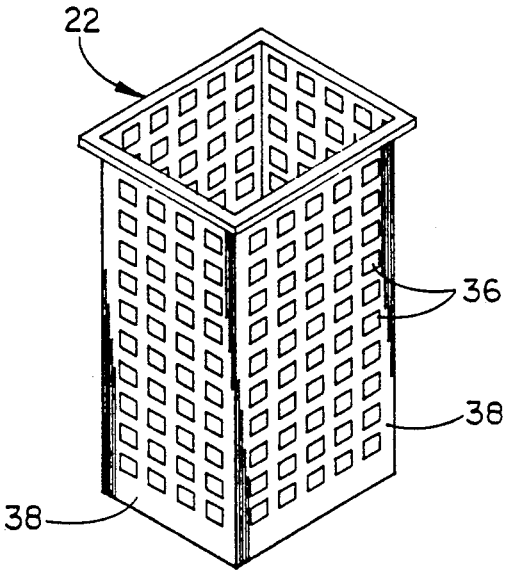
FIG. 3 is a perspective view of a laundry basket of the present invention.

With reference to FIGS. 2 and 3, there is seen two different types of baskets used in the preferred embodiment of the present invention including a soaking tub 25 and a mesh laundry basket 22 (also seen in FIG. 1). The soaking tub 25 includes a solid, water tight surrounding wall structure 32 adapted to contain liquid therein for soaking laundry as desired. Attached to an inner surface of opposite walls of the soaking tub 25, there are handles 34 being structured and disposed so as to facilitate placement and removal of the tub 25 from within a supported position in the housing 12. The soaking tub 25 may also be used as a waste basket in a bathroom or the laundry room. The mesh laundry basket 22 includes a plurality of apertures 36 extending through the surrounding side walls 38 wherein laundry stored in the basket can be properly ventilated.

As seen in FIGS. 1 and 4, the laundry hamper assembly 10 of the present invention further includes a drip compartment 40 extending between the opposite side walls 16 and 17 and preferably down to the bottom floor 18. The drip compartment is accessible through an open top 42 on the top portion 20 so that wet laundry can be placed therein and hung on one of a plurality of hooks 44 attached along an interior wall thereof. The drip compartment 40 is of a water tight construction having a surrounding, solid wall construction. A valve fitting 50 is attached to the side wall 16 near a bottom of the drip compartment 40 being structured to permit drainage of collected water in the compartment 40 as necessary. The valve fitting 50 is preferably of a conventional butterfly valve type having a valve stem 52 adapted to be manipulated so as to open and close the valve passageway 54 as desired extending along the back of the top portion 20, there is a clothes pin tray 56 having a configuration adapted for the placement of clothes pins therein.

Figure 7:
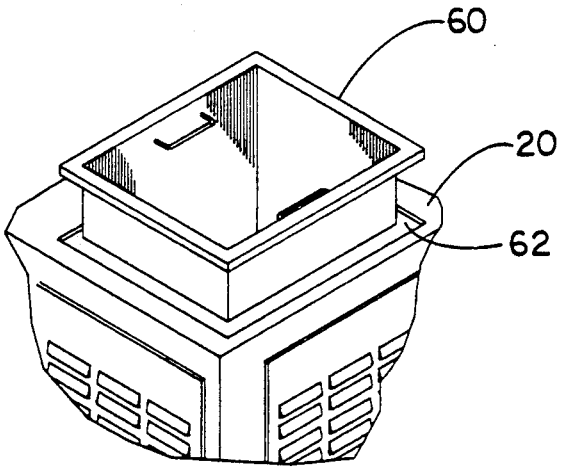
FIG. 7 is a cutaway view shown in perspective illustrating the wash tub removably fitted within a top portion of the housing.

Referring to FIG. 7, each of the baskets including the mesh baskets 22, 23 and 24 and the soaking tub 25 are removably fitted through the top portion 20 so as to extend downwardly into an interior chamber of the housing 12 in a supported position Each of the baskets 22, 23, 24 and 25 includes a flanged top peripheral edge 60 adapted to engage an outer surface of the top portion 20 so that the basket effectively hangs down within the chamber being supported about the flanged edge 60. In the preferred embodiment, the upper surface of the top portion 20 preferably includes a recessed portion 62 congruently configured so as to supportively receive the flanged edge 60 in flush fitting relation therewith.

A covering lid 70 is hingedly attached to the rear wall 19 of the housing 12 near a top edge adjacent to the top portion 20 so that the covering lid 70 is movable between an open position and a closed, covering position disposed in overlying relation to the top portion 20.

To facilitate transport of the assembly, a plurality of rollers or coasters 74 are attached to an under surface of the bottom 18 permitting the entire assembly to be rolled along a floor surface.

Now that the invention has been described,

What is claimed is:

1. A laundry hamper assembly comprising:

a support housing a bottom floor, a front wall, a rear wall, two opposite side walls, and a top portion having a plurality of openings formed therethrough, with an interior chamber of said support housing being accessible through said openings, a plurality of baskets adapted for holding laundry therein, each of said plurality of baskets being structured and configured for passage through one of said openings in said top portion so as to be supported in a substantially vertical orientation extending downwardly within said chamber, said front wall and said opposite side walls each including ventilation grills therein to permit passage of air flow therethrough in ventilating relation to said baskets supported within said interior chamber, at least one of said plurality of baskets including a substantially rigid, mesh, woven construction adapted to permit air flow therethrough, at least one of said plurality of baskets including a solid, water-tight basket having a solid, surrounding wall structure adapted for containment of water and possibly detergent so as to facilitate soaking of laundry therein, said plurality of baskets further adapted for easy removability of a single basket, means for supporting each of said plurality of baskets in a supported position within said openings, wherein an open top of each of said plurality of baskets is positioned in substantially co-planar relation to an upper surface of said top portion, a drip compartment adjacent to said interior chamber and including a water-tight surrounding interior wall structure and an access opening at said top portion, said drip compartment being adapted for containing wet laundry therein, drain means for draining collected water from said drip compartment to an exterior of said support housing, a close pin tray formed in said top portion being structured and disposed for placement and storage of clothes pins therein, and a covering lid hingedly attached along one edge to a correspondingly positioned edge of said support housing so as to be movable between an open position and a closed position, said closed position defined by said lid disposed in covering, overlying relation to said top portion and said open top of each of said plurality of baskets supported therein.

2. An assembly as in claim 1 wherein each of said plurality of baskets includes a flanged upper edge extending downwardly therefrom and structured for supported engagement with an outer surface of said top portion about a periphery of one of said plurality of openings, wherein each of said plurality of baskets are positionable in supported, hanging engagement on said top portion extending downwardly into said interior chamber.

3. An assembly as in claim 2 wherein said solid, water tight basket includes handle means thereon to facilitate placement and removal from said supported engagement with said top portion.

4. An assembly as in claim 1 wherein said drip compartment includes a plurality of hooks attached along an inner wall thereof being structured and disposed for hanging said wet laundry thereon.

5. An assembly as in claim 4 wherein said drip compartment extends transversely substantially between said opposite side walls of said support housing.

6. An assembly as in claim 1 wherein said drain means includes a valve fitting attached adjacent to a lower portion of said drip compartment in liquid receiving relation thereto, said valve fitting being operable between an open, draining position and a closed, sealed position.

7. An assembly as in claim 1 wherein said support housing further includes rollers attached to an exterior under surface of said bottom floor, said rollers being adapted to permit rolling movement of said support housing along a ground surface.

* * * * *